United States Patent [19]

Garrett

[11] Patent Number: 4,476,984

[45] Date of Patent: Oct. 16, 1984

[54] STORAGE RACK

[76] Inventor: John S. Garrett, P.O. Box 72, Erskine, Alta, Canada, T0G 1G0

[21] Appl. No.: 467,822

[22] Filed: Feb. 18, 1983

[30] Foreign Application Priority Data

Feb. 19, 1982 [CA] Canada ..... 396610

[51] Int. Cl.[3] ..... A47F 5/00

[52] U.S. Cl. ..... 211/86; 248/210; 248/222.4

[58] Field of Search ..... 248/210, 211; 211/86; 248/222.4, 223.3, 223.1

[56] References Cited

U.S. PATENT DOCUMENTS

| | | | |
|---|---|---|---|
| 604,549 | 5/1898 | Spencer | 211/86 X |
| 1,216,214 | 2/1917 | Connell | 211/86 X |
| 1,722,529 | 7/1929 | Macdonald | 248/222.4 |
| 2,520,371 | 8/1950 | Pandele | 211/86 |
| 2,837,306 | 6/1958 | Elm | 248/210 |
| 2,911,133 | 11/1959 | Ruggier . | |
| 2,912,205 | 11/1959 | Towne | 248/210 |
| 3,495,683 | 2/1970 | Broden | 248/210 X |
| 3,625,388 | 12/1971 | Golden | 248/210 X |
| 3,642,250 | 2/1972 | Hershey . | |
| 3,707,242 | 12/1972 | Golden et al. . | |
| 3,731,956 | 5/1973 | Hanley | 248/223.1 X |
| 3,738,601 | 6/1973 | Gehringer . | |
| 3,757,380 | 9/1973 | Jackson | 248/211 X |
| 3,822,846 | 7/1974 | Jesionowski . | |
| 4,222,541 | 9/1980 | Cillis | 248/210 |

FOREIGN PATENT DOCUMENTS

| | | |
|---|---|---|
| 412995 | 6/1943 | Canada . |
| 498736 | 12/1953 | Canada . |
| 957654 | 11/1974 | Canada . |
| 1055900 | 6/1979 | Canada . |

*Primary Examiner*—Ramon S. Britts
*Assistant Examiner*—Sarah A. Lechok
*Attorney, Agent, or Firm*—David A. Burge

[57] ABSTRACT

A storage rack for suspended attachment to a ladder has a platform pivotally mounted on spaced vertical parallel members. The platform is adjustable to a substantially horizontal position independent of the incline of the ladder to which the rack is attached. To provide additional storage room the rack may further comprise a tray fixed to the parallel members and extending below the platform and/or a receptacle which can be releasably attached to one of the parallel members and which is adapted to be disposed to one side of the ladder.

15 Claims, 5 Drawing Figures

STORAGE RACK

This invention relates to an attachment for a ladder and, more particularly, to a multi-purpose storage rack capable of being releasably suspended from the rungs of a ladder.

Attachments to ladders for the purpose of supporting utensils in easy reach of a person working on the ladder are known. The known devices include suspendable paint trays such as described, for example, in U.S. Pat. No. 3,757,380 to Jackson, U.S. Pat. No. 3,822,846 to Jesionowski and Canadian Pat. No. 957,654 to Golden. These attachments, however, are generally designed to serve only the single purpose of providing support for a paint tray and are not adapted to conveniently hold items requiring horizontal support such as paint cans, pails, etc. as well as items such as tools.

Prior art attachments also include structures having a tray-like support. It is desirable that such tray-like support is extending in a horizontal plane independent of the inclination of the ladder to which it is attached. In this way containers containing paint or other liquids can be kept level and slipping and sliding of such containers and other materials supported by the attachment can be avoided. Of the known devices, however, many are not adjustable at all. Representative of structures of this type are the devices disclosed in U.S. Pat. No. 3,738,601 to Gehringer and Canadian Pat. No. 1,055,900 to Hopkins. Other known attachments are adjustable to the horizontal positions only to a limited extent. U.S. Pat. No. 3,642,240 to Hershey and U.S. Pat. No. 4,222,541 to Cillis relate to structures of the aforementioned kind. Several of these known attachments are also difficult to construct and/or awkward to handle.

The storage rack according to the invention comprises two parallel members to which a hanger arrangement is attached allowing the storage rack to be suspended from a ladder. A platform member is pivotally secured to the two parallel frame members. The position of the platform can be adjusted to be substantially horizontal independent of the incline of the ladder to which the rack is attached. In this way containers with liquids and the like can safely be placed on the platform with little risk of sliding off or spilling. For storage the platform may be pivoted into a substantially vertical position. The rack may also comprise a tray which is fixed to the two parallel members below the platform and a receptacle which is releasably secured to the outside of one of the parallel members. The tray as well as the box provide easily accessible storage space for all kinds of tools and other utensils which may be required by a person working on the ladder.

When the storage rack according to the invention is attached to a ladder by way of the hanger arrangement, the parallel members are located just inside the two rails of the ladder and rest against one or more of the rungs of the ladder suspending the rack in a stable and secure manner.

Accordingly, the present invention provides a storage rack adapted to be releasably attached to a ladder which has two side rails spaced from one another at a given transverse spacing and a plurality of rungs, whereby each rung is spaced from adjacent rungs at a given longitudinal spacing. The storage rack comprises:

(a) Two generally parallel elongate members spaced such that their external clearance is slightly less than the given transverse spacing of the respective ladder.

(b) A tray-like platform member pivotally secured to the two parallel members so as to pivot between a substantially vertical and a substantially horizontal position about an axis which extends generally perpendicular to the parallel members. Preferably, the platform members pivots about a shaft which extends between and is secured to the two parallel members.

(c) Hanger means having hook-shaped elements attached to one end of the parallel members and spaced from the opposite end of the parallel members a distance in excess of the longitudinal spacing of the respective ladder. Preferably the hanger means include two hook-shaped elements connected by a bar.

(d) Adjustment means for selectively adjusting the inclination of the platform member relative to the two parallel members, so that the platform member can extend generally horizontally at different angles of inclination of a ladder with which the rack is used. Preferably, the adjustment means include a hook means fixed to one of the parallel members and a chain attached to the platform member, whereby the chain is engageable with the hook means, so as to adjust the inclination of the platform member relative to the two parallel members.

The storage rack according to the invention may include a tray which is fixedly secured to the two parallel members and extends therebetween in a plane transverse to the plane of coincidence of the two parallel members and below the platform member.

The storage rack may further comprise attachment means which preferably include two stud means which protrude from one of the parallel members and are positioned below one another. More preferably the attachment means comprise a plate means which is secured to one of the parallel members and from which two stud means protrude.

In a preferred embodiment the storage rack according to the present invention includes a receptacle, preferably of box-like configuration, adapted to be disposed to one side of the respective ladder and a support bracket for supporting the receptacle and for releasably attaching the receptacle to one of the parallel members. Preferably, the support bracket includes a first and a second leg. The first leg supports the box-like receptacle and spaces the receptacle from the parallel member to which the attachments means are secured. In this way the side rail of the ladder has room between the receptacle, which is positioned to one side of the ladder, and the parallel member to which the receptacle is attached. The second leg extends generally perpendicular to the first leg and is provided with at least two slots which are adapted to receive the protruding stud means for releasably attaching the receptacle to the parallel member.

The present invention will now be described in more detail with reference to the accompanying drawings which illustrate, by way of example, preferred embodiments of the invention and in which.

Figure 1:
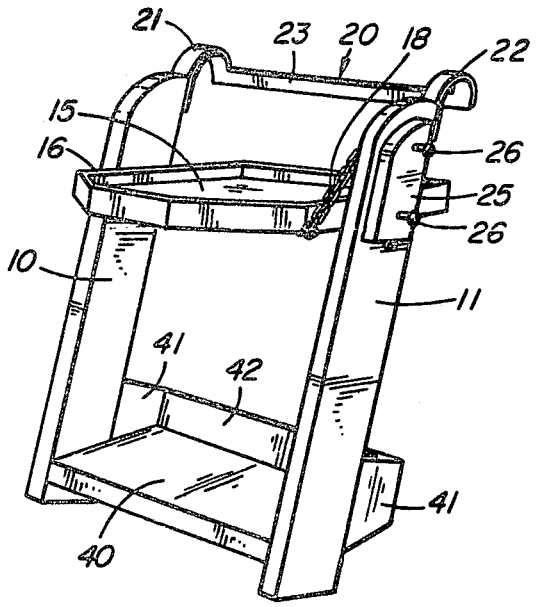
FIG. 1 is a perspective front view of a preferred embodiment of the invention.

Referring to the drawings, the preferred embodiments of the storage rack shown in FIGS. 1 to 5 include two parallel members 10 and 11. A hanger means 20 consisting of two hooks 21 and 22 shaped to fit over a rung 2 of a ladder 1 and connected by a bar 23 is fixed to the upper end of the two parallel members 10 and 11. The distance between the two parallel members is slightly shorter than the distance between the two side rails 3 of the ladder so that both parallel members fit between the two side rails. In this way, when the hooks 21 and 22 are in engagement with a rung of the ladder, the two parallel members rest against one or more of the rungs therebelow.

A tray-like platform 15 extends between the upper portions of the two parallel members. The platform is secured to a pivot bar 14 by brackets 13 or the like (see FIGS. 4 and 5). In this way, the platform can be pivoted between vertical and horizontal positions. The pivot bar 14 extends between the two parallel members and is secured at each end to one of the parallel members. A chain 18 is fastened to the platform 15 and a hook 17 or the like is attached to at least one of the parallel members. With the chain and hook arrangement, the platform 15 can be adjusted to a horizontal position independent of the angular position of the ladder. In the horizontal position, the platform 15 projects to the front as well as to the rear of the parallel members. However, the platform in its horizontal position does not project so far to the front as to unduly interfere with the movement of the person working on the ladder. The platform is surrounded with an upwardly projecting rim 16.

Figure 4:
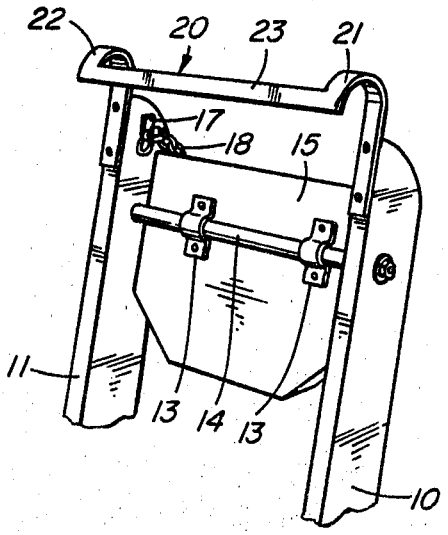
FIG. 4 is a partial perspective rear view of one preferred embodiment with the platform in storing position.

In the embodiment shown in FIG. 4 the platform is constructed such that, once the chain is adjusted, the platform remains in the horizontal position. Only upon release of the chain, the platform pivots in forward direction into the vertical storage position shown in FIG. 4.

Figure 5:
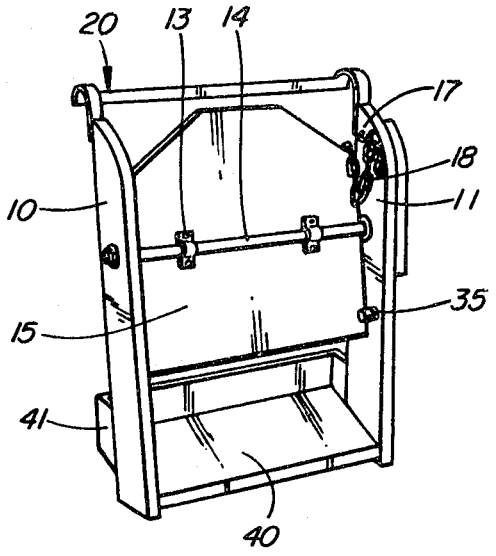
FIG. 5 is a perspective front view of another preferred embodiment with the platform in a vertical position.

In a more preferred embodiment of the invention shown in FIG. 5, the pivot bar 14 is placed in relation to the platform 15 such that, when the platform is not in use, i.e. when no load is placed on it, the platform tends to pivot rearwardly into the vertical storing position shown in FIG. 5. When the platform is to be used, the chain 18 is adjusted to bring the platform into a horizontal position and then the paint can or other load is placed on the platform. The load prevents the platform from falling in rearward direction. For easy reach such a load is generally placed in front of the rung of the ladder with which hanger means 20 is engaged. In this way the load counterbalances the tendency of the platform to pivot rearwardly. As soon as the load is removed, the platform pivots rearwardly while the chain remains engaged with the hook. In this way the chain does not have to be readjusted for consecutive uses unless the incline of the ladder is changed. A stopper device 35 or the like may be installed to prevent the platform from swinging too far towards the front of the rack.

A plate means or a block 25 is attached to the upper portion of either of the parallel members on the side which faces one of the side rails 3 of the ladder. In the embodiments shown in FIGS. 1 and 2 plate 25 is fastened to parallel member 11. Plate 25 is provided with two protruding screws or studs 26.

Figure 2:
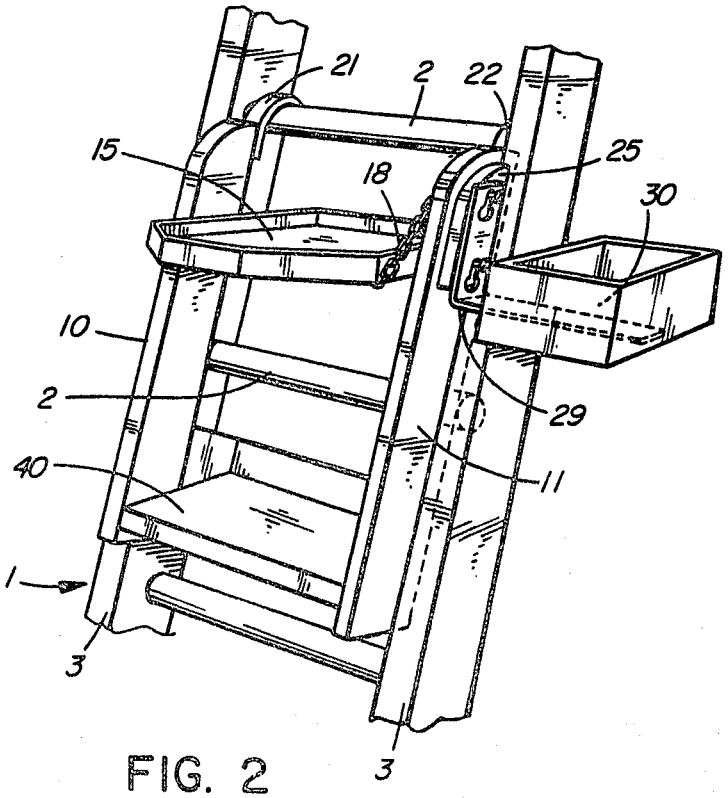
FIG. 2 is a perspective front view of the embodiment shown in FIG. 1 when suspended from a ladder.
Figure 3:
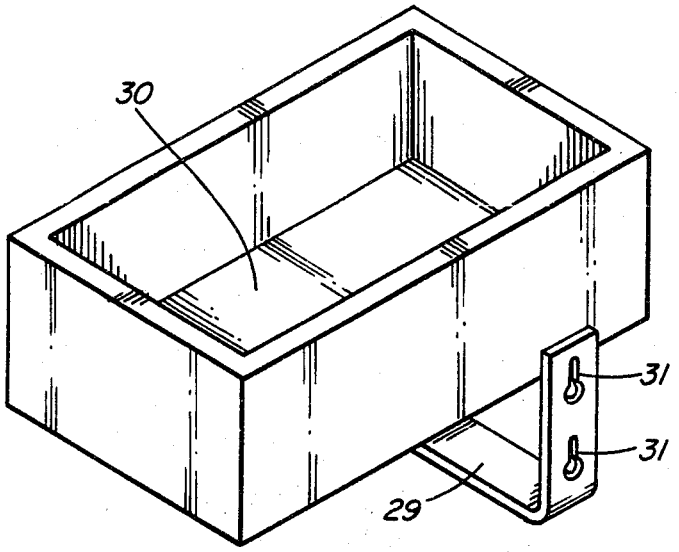
FIG. 3 is a perspective view of a preferred receptacle according to the invention.

A box-shaped receptacle or utility box can be connected to plate 25 as shown in FIG. 2. The box is provided with a support bracket 29 which is generally L-shaped. One leg of the L is fastened to the bottom of the box and extends across the bottom of the box and a short distance beyond the box from where the second leg extends upwardly at an angle of about 90°. This second leg is provided with two slots 31 which cooperate with the studs 26 on plate 25 to secure the box 30 to the parallel member.

A tray 40 is attached to the lower portion of the parallel member. The tray extends in a generally horizontal plane between the parallel members and projects in rearward direction. The tray is provided with sidewalls 41 and a back wall 42.

The present storage racks may be constructed of a variety of materials such as wood, metal and plastic. For example, the parallel members and the platform, tray and box as well as plate 25 may be made of wood and the hanger means and support bracket may be formed of metal and screwed to the wooden parts of the structure.

When the storage rack is to be used, the hanger 20 is hooked over a rung of the ladder at the desired height, thus suspending the storage rack securely from the ladder. Either prior to or after engagement of the rack to the ladder, box 30 may be connected, if desired, to plate 25 by engaging slots 31 with studs 26. The platform 15 is adjusted to a horizontal position by engaging the appropriate link of adjustment chain 18 with hook 17, thus preparing the rack for use. The platform is large enough to support paint cans, paint trays, pails, etc. The fact that the platform is level minimizes the tendency of any utensils to slide off the platform. Rim 16 reduces accidental slipping due to jerks or jolts of the ladder. The tray 40 can be used to store rags, brushes, scrapers, etc. and box 30 may be used for holding all kinds of tools in easy reach of the person on the ladder.

After use, the load is removed from the platform. In the embodiment shown in FIG. 5 this causes the platform to automatically fall in rearward direction into the vertical position without necessitating the release of chain 18. In this way the platform can be put into the storing position while the chain is still engaged with the hook and ready for the next use.

The storage rack can easily be removed from the ladder by disengaging hanger 20 from the rung. In the embodiment of the invention shown in FIG. 4, it is advantageous to release chain 18 from hook 17 before storing the structure away so that the platform 15 can pivot into the vertical position. In this way the structure takes up less storage space. Box 30 may also be removed and stored or used separately.

In order to save storage space the utility box 30 can be placed on the tray 40 between the platform in its vertical position and the back wall 42 of the tray. Storing the box 30 in this manner is particularly convenient in the embodiment shown in FIG. 5 where the stopper device 35 limits the movement of the platform and, thus, of the box. In this way the box does not fall or slip out of the tray, even if the rack is tilted.

Although preferred embodiments of the invention have been described in detail, it is to be understood that modifications and variations may be effected without departing from the spirit and scope of the invention.

I claim:

1. A storage rack adapted to be releasably attached to a ladder having two side rails spaced from one another at a given transverse spacing and a plurality of rungs, said storage rack comprising:

(a) two generally parallel elongate members spaced such that their external clearance is slightly less than the given transverse spacing of the respective ladder, said parallel members each having a generally rectangular cross-sectional configuration defined by an outer side surface, an inner side surface, a rear surface perpendicular to the side surfaces and a front surface opposed to the rear surface, said side surfaces being wider than the front and rear surfaces, so that, when the rack is attached to a respective ladder, said parallel members extend substantially parallel to the rails of the ladder, said rear surfaces rest against the respective rungs, and a part of one outer side surface protrudes forwardly beyond the respective rail of the respective ladder;

(b) attachment means fixedly secured to said part of at least one outer side surface, for securing to said part a supplementary device;

(c) a tray-like platform member pivotally secured to said two parallel members so as to pivot between a substantially vertical and a substantially horizontal position about an axis which extends generally perpendicularly between said two parallel members;

(d) hanger means having hook-shaped elements attached to one end of the parallel members at the rear surfaces thereof and curved rearwards away from the plane defined by the two rear surfaces, said hook-shaped elements being spaced from the opposite ends of the parallel members a distance in excess of the spacing between two adjacent rungs of the respective ladder; and, (e) adjustment means for selectively adjusting the inclination of the platform member relative to the two parallel members, said adjustment means including a hook-up means fixedly secured to one of said parallel members and an elongate connecting element fixedly attached at one end thereof to said platform member at a point proximate to said one parallel member, said elongate connecting member being engageable at a point thereof remote from said one end with said hook-up means, so as to adjust the inclination of the platform member relative to the two parallel members by selectively adjusting the effective length of said elongate connecting member, whereby the platform member can be arranged to extend generally horizontally at different angles of inclination of a ladder with which the rack is used.

2. A storage rack as claimed in claim 1 further comprising a tray fixedly secured to the two parallel members and extending therebetween below said platform member in a plane substantially transverse to the plane of coincidence of the two parallel members.

3. A storage rack as claimed in claim 2 wherein the adjustment means comprise a hook and chain arrangement.

4. A storage rack as in claim 3 wherein said platform member is pivotable into the substantially vertical position without prior disengagement of the chain from the hook means.

5. A storage rack as claimed in claim 4, wherein said platform member is secured to said shaft such that the adjusted platform member pivots generally automatically into the substantially vertical position unless a load rests on the platform member.

6. A storage rack as claimed in claim 3, wherein said platform member is secured to said shaft such that the platform member, when adjusted, is maintained in the substantially horizontal position until the chain is disengaged from the hook means.

7. A storage rack as claimed in claim 1 wherein said platform member pivots about a shaft which extends between and is secured to the two parallel members.

8. A storage rack as claimed in claim 1 wherein the hanger means include two hook-shaped elements connected by a bar.

9. A storage rack as claimed in claim 1 wherein the adjustment means comprise a hook and chain arrangement.

10. A storage rack as claimed in claim 1, wherein the supplementary device is a receptacle.

11. A storage rack as claimed in claim 1 wherein the attachment means include a plate means having two protruding stud means.

12. A storage rack as claimed in claim 11 further comprising:

(i) a receptacle of box-like configuration disposed to one side of the respective ladder;

(ii) a receptacle support including a first leg for supporting the box-like receptacle and for spacing said receptacle from the parallel member to which the attachment means are secured, and a second leg generally perpendicular to the first leg and having at least two slots adapted to receive said protruding stud means for releasably attaching the receptacle.

13. A storage rack as claimed in claim 12 further comprising a tray fixedly secured to the two parallel members and extending therebetween below said platform member.

14. A storage rack as claimed in claim 13 further comprising:

(i) a receptacle disposed to one side of the respective ladder; and (ii) a receptacle support bracket for supporting said receptacle and for releasably attaching said receptacle to said attachment means.

15. A storage rack as claimed in claim 14 further comprising a tray fixedly secured to the two parallel members and extending therebetween below said platform member.

* * * * *